US005226221A

United States Patent [19]

Kilgore

[11] Patent Number: 5,226,221

[45] Date of Patent: Jul. 13, 1993

[54] METHOD OF MAKING A HERMETICALLY SEALED OVERMOLDED FREE-STANDING SOLENOID COIL

[75] Inventor: David C. Kilgore, Yorktown, Va.

[73] Assignee: Siemens Automotive L.P., Auburn Hills, Mich.

[21] Appl. No.: 614,463

[22] Filed: Nov. 15, 1990

[51] Int. Cl.[5] ..... H01F 41/06

[52] U.S. Cl. ..... 29/605; 264/272.19; 336/96

[58] Field of Search ..... 29/602.1, 605; 264/272.19; 336/96

[56] References Cited

U.S. PATENT DOCUMENTS

| | | | |
|---|---|---|---|
| 3,045,290 | 7/1962 | Anderson et al. | 264/272.19 |
| 3,240,848 | 3/1966 | Burke et al. | 264/272.19 |
| 3,348,143 | 10/1967 | Hodges et al. | 29/605 X |
| 3,848,208 | 11/1974 | Dawson et al. | 336/192 X |

*Primary Examiner*—Carl E. Hall

*Attorney, Agent, or Firm*—George L. Boller; Russel C. Wells

[57] ABSTRACT

A solenoid coil is fabricated by precision winding a length of magnet wire to form a free-standing coil, disposing the coil on a terminal holder containing electrical terminals, connecting the wire terminations to the electrical terminals, supporting such a sub-assembly within a mold cavity, injecting flowable plastic material into the cavity to wholly envelop the coil, the terminal holder and proximal portions of the terminals, allowing the plastic to cure and thereby form an enclosure which is devoid of any seams extending from its exterior to either the coil or the terminal holder, and then removing the encapsulated assembly from the mold cavity. This produces a solenoid coil that is well-suited for use in high-pressure "wet" environments because the encapsulated assembly is strong and leak-proof and it has sealing surfaces whose surface finish and dimensions are closely controlled.

5 Claims, 1 Drawing Sheet

METHOD OF MAKING A HERMETICALLY SEALED OVERMOLDED FREE-STANDING SOLENOID COIL

FIELD OF THE INVENTION

This invention relates to a method of making a solenoid coil and to a solenoid made by the method.

BACKGROUND AND SUMMARY OF THE INVENTION

Solenoids are sometimes used in "wet" interior environments within certain devices. Yet the electrical connections to the solenoids must be made exterior of the "wet" environments. In some of these devices the interior environments contain pressurized fluid whose leakage to the exterior must be prevented. One example of such a device is a high-pressure fuel injector that is used to inject fuel directly into a combustion chamber of an internal combustion engine. Such an injector may experience internal pressures as high as about 2,000 psi. The solenoid coil must be constructed to withstand the rigors of such usage by continuing to operate properly over its lifetime, and it must also remain sealed with respect to the injector body so that fuel does not leak past the solenoid coil to the exterior of the injector. Typically, these requirements are met by encapsulation of the solenoid coil in a suitable encapsulant material. Attainment of proper sealing requires strict compliance with both surface finish and dimensional control for the involved sealing surfaces, and as pressures become larger, surface finish and dimensional control become more important.

The present invention relates to a new and unique, and cost-effective, method of making an encapsulated solenoid coil that will exhibit those characteristics necessary for high pressure usage. The specific methodology will be disclosed in the ensuing description which is accompanied by drawings. The disclosure presents a presently preferred embodiment in accordance with the best mode contemplated at the present time for carrying out the invention. Additional features and advantages may also be perceived by the reader as the disclosure proceeds.

DESCRIPTION OF THE PREFERRED EMBODIMENT

Figure 1:
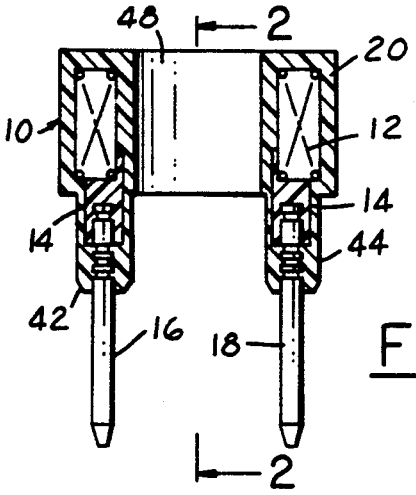
FIG. 1 is a longitudinal cross section through a solenoid coil made by the method of the present invention, as taken in the direction of arrows 1—1 in FIG. 2.
Figure 2:
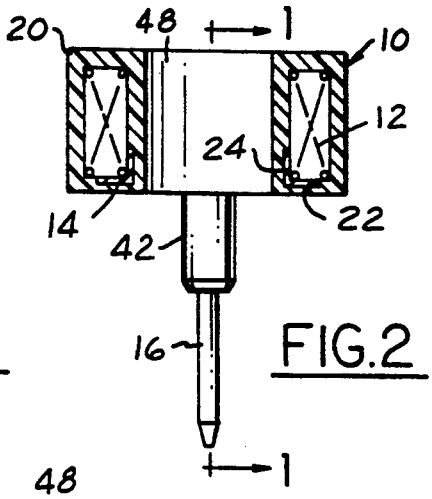
FIG. 2 is a longitudinal cross section through the solenoid coil made, by the method of the present invention, as taken in the direction of arrows 2—2 in FIG. 1.
Figure 3:
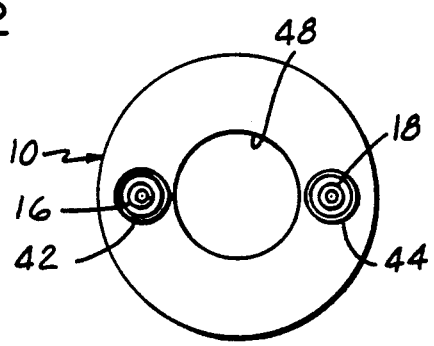
FIG. 3 is an axial end view as taken in the direction of arrows 3—3 in FIG. 1.

An example of a solenoid coil 10 that has been made in accordance with the inventive principles is presented in FIGS. 1, 2, and 3. Solenoid coil 10 comprises a coil

12, a terminal holder 14, two electrical terminals 16, 18, and an enclosure 20.

Coil 12 is created by winding a length of magnet wire into a general circular cylindrical tubular shape. The winding operation is conducted in any conventional manner using conventional coil winding equipment. For high pressure usage of solenoid coil 10, it is preferred to use bondable magnet wire that is precision wound onto a mandrel and then heated and axially compressed to cause the wire convolutions to bond into essentially a unitary mass and thereby form a free-standing coil. An example of such processing is illustrated in U.S. Pat. No. 3,348,183, and while that example shows the application of axial compression in an amount sufficient to deform the cross section of the electrically conductive metal core of the wire, such a large degree of axial compression is not necessarily essential to the fabrication of a free-standing coil.

Terminal holder 14 is an electrical non-conductor, for example a suitable plastic. It is fabricated by any conventional process, such as injection molding. Although a sub-assembly consisting of parts 14, 16, 18 can be created by assembling terminals 16, 18 to terminal holder 14 after the latter has been molded, an alternate procedure contemplates that the plastic material that is used to form the terminal holder be insert-molded onto the two terminals by means of an insert mold into which the terminals are inserted prior to the introduction of the plastic into the cavity of the mold. The result of employing this alternate procedure is the creation of a unitary sub-assembly consisting of the three parts 14, 16, 18.

The process of creating coil 12 leaves two terminations at opposite ends of the magnet wire. These two terminations are respectively electrically connected to appropriate connection points on the respective terminals 16, 18 by any conventional process. Depending upon the particular processing that is used to create the sub-assembly consisting of parts 14, 16, 18, the electrical connections of the magnet wire's ends to the electrical terminals may be made either before or after the creation of the sub-assembly. For example, if a unitary sub-assembly of parts 14, 16, 18 is created by the insert-molding procedure just described, these electrical connections can be made after coil 12 has been associated with the sub-assembly; the same would hold true even if the sub-assembly is created by mounting the electrical terminals on terminal holder 14 after the latter has been fabricated. For another example, if the mounting of electrical terminals 16, 18 on terminal holder 14 is conducted after the latter has been fabricated, then the connections of the wire magnet to the two electrical terminals could be made before the latter are mounted on the terminal holder. It is even conceivable for the connections of the wire magnet to the two terminals to be made before the terminal holder is created and then creating the terminal holder by insert molding onto the terminals. Such an insert-molding step could include the molding of plastic material around the electrical connections of the magnet wire to the terminals so that the connections are either wholly or partially enveloped by the plastic material of the terminal holder. Alternatively, the connections could be left totally exposed at this stage of the solenoid coil fabrication process.

Figure 4:
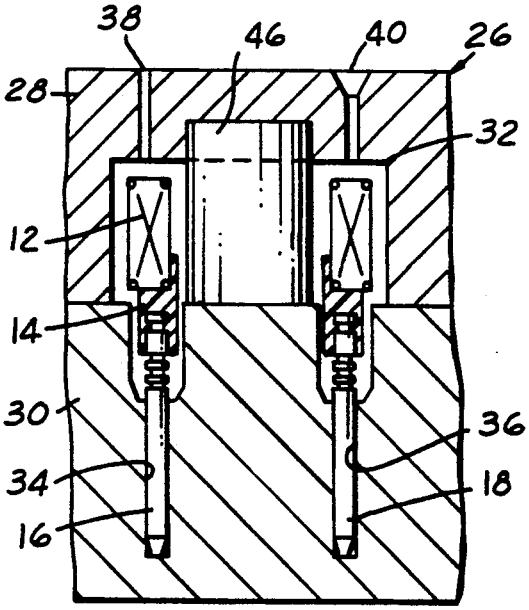
FIG. 4 is a longitudinal cross section through a mold that is used in the performance of certain steps of the method. This Fig. illustrates a partially completed solenoid coil.
Figure 5:
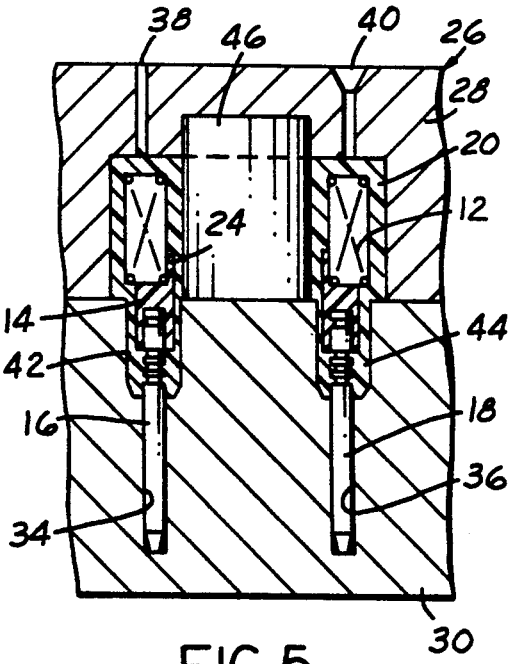
FIG. 5 is a view similar to FIG. 4 illustrating the completed solenoid coil.

It is preferred that terminal holder 14 have a circular annular shape and that it include an axial and radial locating means for axially and radially locating coil 12 when the latter is associated therewith. Such locating means is provided by making terminal holder 14 to have a circular annular base 22 and a circular annular flange 24 projecting axially from the I.D. of base 22 at one end. The O.D. of flange 24 is just slightly less than the I.D. of coil 12 so as to allow the coil and terminal holder to axially fit together in the manner illustrated by FIGS. 4 and 5 wherein coil 12 is shown supported uprightly on base 22. After this much of the process has been completed, enclosure 20 can be created.

Enclosure 20 is created by the use of a mold 26 (FIGS. 4 and 5) and conventional injection molding apparatus (not shown). Mold 26 comprises two halves 28, 30 which cooperatively define a mold cavity 32 when they are in the closed condition portrayed by FIGS. 4 and 5. The mold is constructed such that the entirety of coil 12, the entirety of terminal holder 14, and proximal portions of terminals 16, 18 are disposed within cavity 32 in spaced relation to the cavity's wall. The sub-assembly consisting of parts 12, 14, 16, 18 is supported on mold half 30 by disposing distal portions of terminals 16, 18 within closely fitting holes 34, 36 that extend from the wall of cavity 32 within mold half 30.

Mold 26 further comprises entrance porting 38 via which flowable plastic encapsulant is introduced into cavity 32 to fill the cavity's space that is not occupied by parts 12, 14, 16, 18. The mold also comprises vent porting 40 via which gases can escape the cavity as the flowable plastic is being introduced. It is to be appreciated that in certain respects the illustration of portings 38, 40 is of a somewhat schematic nature and that actual mold construction may involve multiple ports at different locations. Regardless, the intent is that the plastic flow to fill the entirety of the cavity void. The plastic is then allowed to cure and thereby form enclosure 20. The result is that the encapsulant wholly envelops the entirety of coil 12, the entirety of terminal holder 14, and the proximal portions of terminals 16, 18 without the formation of any seams extending from the exterior surface of enclosure 20 to either coil 12, terminal holder 14, or the proximal portions of terminals 16, 18. Since the connections of the ends of the magnet wire to terminals 16, 18 are disposed within cavity 32 irrespective of whether they are or are not enclosed, either wholly or partially, by terminal holder 14, they too are wholly enclosed by enclosure 20.

After a sufficient amount of curing, the mold halves are opened in a sufficient amount to allow the finished solenoid coil 10 to be removed from between the open mold halves. It is also to be observed that the mold construction inhibits the intrusion of plastic material into holes 34, 36 so that the distal portions of the terminals are free of any covering and therefore ready for connection to a mating connector plug when the device into which the solenoid is ultimately assembled is put to use. It is also to be noted that cavity 32 is shaped immediately adjacent each hole 34, 36 such that terminal towers 42, 44 are created diametrically opposite each other in the finished part in covering relation to underlying tower formations in terminal holder 14 for terminals 16,18.

Mold 26 is constructed to form, when closed, a cylindrical post 46 concentric with the longitudinal axis of coil 12. This post creates a zone within the mold cavity which cannot be filled by the plastic. As a result, enclosure 20 has a circular, cylindrical through-hole 48 that is concentric with coil 12.

The method that has been described is a cost-effective way to fabricate a solenoid coil that is to be used in a high-pressure, "wet" environment. By making coil 12 free-standing (i.e., bobbinless), the use of a bobbin is rendered unnecessary. During the process of introducing the flowable plastic into cavity 32, coil 12, terminal holder 14, and terminals 16, 18 will be subjected to certain forces. The illustrated construction for terminal holder is advantageous because it aids in resisting deflections that may be induced by the molding process. Terminals 16, 18 are also sufficiently strong to resist undesired deflections, and of course the free-standing coil 12 has inherent strength. If deemed appropriate, such form of joining medium could be employed between coil 12 and terminal holder 14 to aid in resisting accidental separation during handling of the sub-assembly prior to encapsulation by the molding step, and for example a suitable adhesive could be applied between their confronting surface portions. The molding step achieves proper surface finish and dimensional control for sealing surfaces at the exterior of enclosure 20, for example around the outside of terminal towers 42, 44. While a presently preferred embodiment of the invention has been illustrated and described, it is to be appreciated that the inventive principles may be practiced in other equivalent ways.

What is claimed as the invention is:

1. A method of making a solenoid coil which comprises:

fabricating a bobbinless, free-standing coil by winding a length of magnet wire into a wound coil and applying axial compressive force and heat to the wound coil to cause its convolutions to bond into essentially a unitary mass;

connecting terminations of said wire to electrical terminals;

then supporting said bobbinless, free-standing coil within a mold cavity by means of a terminal holder which includes said terminals such that the entireties of said wound coil and of said terminal holder, including the connections of said wire terminations to said electrical terminals, are disposed within said mold cavity in spaced relation to a wall means that defines said mold cavity, said supporting step including supporting said terminal holder within said mold cavity by means of a distal portion of said terminals such that said terminals are disposed in vertically underlying support of said terminal holder and coil during such supporting step and also during an introducing step which comprises;

introducing a flowable encapsulant into space within said mold cavity that is not occupied by said bobbinless, free-standing coil or said terminal holder, including said connections and a proximal portion of said terminals, such that said encapsulant wholly envelops the entireties of said bobbinless, free-standing coil and of said terminal holder, including said connections and proximal portion of said terminals; and then allowing said encapsulant to cure into an enclosure which is devoid of any seams extending from an exterior surface thereof to said bobbinless, free-standing coil or to said portion of said terminal holder, including said connections.

2. A method as set forth in claim 1 in which said introducing step is conducted such that flowable encapsulant is excluded from a zone that causes said enclosure to have an axially extending hole passing interiorly of said wound coil.

3. A method as set forth in claim 2 in which said introducing step is conducted such that the exclusion of flowable encapsulant from said zone causes said hole to be a through-hole.

4. A method of making a solenoid coil which comprises:

fabricating a bobbinless, free-standing coil by winding a length of magnet wire into a wound coil and applying axial compressive force and heat to the wound coil to cause its convolutions to bond into essentially a unitary mass;

connecting terminations of said wire to electrical terminals;

then supporting said bobbinless, free-standing coil within a mold cavity by means of a terminal holder which includes said terminals such that the entirety of said wound coil and at least a portion of said terminal holder, including the connections of said wire terminations to said electrical terminals, are disposed within said mold cavity in spaced relation to a wall means that defines said mold cavity;

introducing a flowable encapsulant into space within said mold cavity that is not occupied by said bobbinless, free-standing coil or said portion of said terminal holder, including said connections, such that said encapsulant wholly envelops the entirety of said bobbinless, free-standing coil and said portion of said terminal holder, including said connections; and then allowing said encapsulant to cure into an enclosure which is devoid of any seams extending from an exterior surface thereof to said bobbinless, free-standing coil or to said portion of said terminal holder, including said connections;

in which said terminal holder is made by molding a plastic material onto said electrical terminals.

5. A method as set forth in claim 1 in which said terminal holder comprises locating means for axially and radially locating said wound coil thereon, said supporting step comprises disposing said wound coil on said terminal holder, and said locating means functions to locate said wound coil on said terminal holder as said wound coil is being disposed on said terminal holder.

* * * * *